US007891401B2

(12) United States Patent
Decola

(10) Patent No.: US 7,891,401 B2
(45) Date of Patent: Feb. 22, 2011

(54) SYSTEMS FOR BRACING GARAGE DOORS AGAINST HURRICANE FORCE WINDS

(76) Inventor: Salvatore Michael Decola, 1340 Ambra Dr., Viera, FL (US) 32940

( * ) Notice: Subject to any disclaimer, the term of this patent is extended or adjusted under 35 U.S.C. 154(b) by 383 days.

(21) Appl. No.: 12/016,424

(22) Filed: Jan. 18, 2008

(65) Prior Publication Data

US 2009/0183842 A1 Jul. 23, 2009

(51) Int. Cl.
*E05D 15/26* (2006.01)

(52) U.S. Cl. ..... 160/264; 160/209

(58) Field of Classification Search ..... 160/209, 160/133, 264, 201; 52/127.2, 167.3
See application file for complete search history.

(56) References Cited

U.S. PATENT DOCUMENTS

| | | | | | |
|---|---|---|---|---|---|
| 1,241,425 | A * | 9/1917 | Nelson | 160/264 |
| 3,237,682 | A * | 3/1966 | Davis | 160/269 |
| 3,265,118 | A * | 8/1966 | Smith | 160/209 |
| 3,424,223 | A * | 1/1969 | Rosenblatt | 160/209 |
| 3,443,625 | A * | 5/1969 | Moser et al. | 160/181 |
| 3,732,913 | A * | 5/1973 | Wrono | 160/133 |
| 3,853,166 | A * | 12/1974 | Wrono | 160/133 |
| 4,085,788 | A * | 4/1978 | Bernardo | 160/133 |
| 4,817,907 | A * | 4/1989 | Cougan | 248/558 |
| 4,934,439 | A * | 6/1990 | Martin | 160/201 |
| 5,046,544 | A * | 9/1991 | Coluccio | 160/201 |
| 5,240,216 | A * | 8/1993 | Lin et al. | 248/300 |
| 5,284,199 | A * | 2/1994 | Finch et al. | 160/133 |
| 5,383,509 | A * | 1/1995 | Gaffney et al. | 160/209 |
| 5,445,207 | A * | 8/1995 | Romanelli et al. | 160/209 |
| 5,620,038 | A | 4/1997 | DeCola et al. | 160/209 |
| 5,706,877 | A * | 1/1998 | Grisham et al. | 160/201 |
| 5,732,758 | A * | 3/1998 | Marko | 160/201 |
| 5,819,834 | A * | 10/1998 | Wedekind | 160/209 |
| 5,964,269 | A | 10/1999 | Decola | 160/209 |
| 5,967,216 | A * | 10/1999 | Mancini | 160/209 |
| 6,082,431 | A | 7/2000 | Decola | 160/209 |
| 6,385,916 | B1 * | 5/2002 | Marko | 52/127.2 |
| 6,669,156 | B2 * | 12/2003 | East et al. | 248/300 |
| 6,776,210 | B2 * | 8/2004 | Wells | 160/209 |
| 6,796,361 | B1 * | 9/2004 | Campbell et al. | 160/209 |
| 6,994,144 | B2 * | 2/2006 | Fletcher | 160/209 |
| 2005/0072533 | A1 * | 4/2005 | Vincent | 160/133 |
| 2006/0243400 | A1 * | 11/2006 | Becka | 160/201 |
| 2007/0151677 | A1 * | 7/2007 | East et al. | 160/209 |
| 2007/0215294 | A1 * | 9/2007 | Barrow | 160/209 |

* cited by examiner

*Primary Examiner*—David Purol
(74) *Attorney, Agent, or Firm*—Allen, Dyer, Doppelt, Milbrath & Gilchrist, P.A. Attorneys at Law

(57) ABSTRACT

Equipment and techniques for bracing roll down doors of a building having a plurality of horizontal door panels against severe winds and security against burglary use a horizontal cross bar mounted to the building at connector locations on either side of the door panels. At least one vertical support bar connects to the horizontal cross bar at locations intermediate to the ends of the horizontal cross bar and is secured to the floor using a floor mount. The vertical support bar is connected to door panels using a rotatable hook. The equipment can be provided in a kit form for easy installation.

27 Claims, 21 Drawing Sheets

SYSTEMS FOR BRACING GARAGE DOORS AGAINST HURRICANE FORCE WINDS

FIELD OF THE INVENTION

The present invention relates in general to garage door systems, and is particularly directed to a door bracing system made of grooved telescoping column members, that are attachable to a garage door and to the structure of the garage building proper, so as to reinforce and anchor a multi-paneled garage door against high velocity winds and against intrusive using instruments.

BACKGROUND OF THE INVENTION

A typical multi-panel residential garage door is comprised of a plurality of panels (usually made of galvanized steel or fiberglass), which are hinged together at hinge joints. The hinge joints are equipped with side wheels or rollers that ride in a pair of guide tracks that extend along opposite sides of the garage door opening. The guide tracks are usually anchored (e.g., bolted) to wall regions of the garage adjacent to the opening and attached via brackets to the ceiling. The door may be opened and closed either by hand or by way of an automated garage door translation device, such as may be mounted to the ceiling and attached to the topmost one of the door panels.

As described in DeCola et al, U.S. Pat. No. 5,620,038, entitled: "System for Bracing Garage Door Against Hurricane Force Winds", also described in Decola, U.S. Pat. No. 5,964,269, entitled: "System of Telescoping Longitudinally Grooved Door-Stiffening Columns For Bracing Garage Door Against Hurricane Force Winds", and as described in Decola, U.S. Pat. No. 6,082,431, entitled: "System of Telescoping Longitudinally Grooved Door-Stiffening Columns For Bracing Garage Door Against Hurricane Force Winds," (the disclosure of each of which is incorporated herein by reference in its entirety), when a multi-panel garage door is exposed to high velocity winds of a violent storm, such as a hurricane, the door panels have a tendency to separate from the guide tracks as a result of continued flexing of the panels and fatigue of the tracks themselves. This repeated flexing causes the side wheels to become detached from the tracks so that the ends of panels become warped, allowing wind to enter the garage and literally rip or 'peel' the door away from the garage door opening. Once the garage and adjacent structure has been blown out, the ceiling of the garage and adjacent structure are no longer protected from the extremely high velocity winds of the storm, and it is simply a matter of time before the roof blows off, causing the entire structure to be destroyed.

Follow-up investigation to the widespread damage to residential buildings in south Florida by Hurricane Andrew in 1992 has revealed that had garage doors been reinforced against such separation from the guide tracks, and not blown out, the full force of the hurricane would not have been able to enter many of the destroyed houses. As a result of this investigation, homebuilders in coastal areas of south Florida are required to provide some form of hurricane reinforcement for their garage doors. Recommendations of how to accomplish this have usually involved the installation of (metal or wooden) girts that extend horizontally across each panel. Such girts are intended to stiffen the panels and prevent their oscillatory motion that leads to the destructive separation from the tracks.

Unfortunately, such stiffening panels add considerable weight to the door, requiring adjustments of both the lifting coil spring and of the drive of the automated garage door translation mechanism. Moreover, even with such adjustment, the substantial weight of the girts, for which neither the door nor the automated translation mechanisms were originally designed, leads to further wear and tear of the automatic garage door opener. Yet, even with such stiffeners, the fundamental problem they are intended to solve is not remedied, since they do not prevent torquing of the panels at the point of attachment of the door to the tracks, and do not effectively relieve the wind load placed on the entire garage door opening. The girts are unable to prevent torquing since they extend horizontally-making them parallel to joint lines between panels. Such an orientation provides axes of rotation, about which the panels are torqued when subjected to high velocity winds. The girts provide neither reinforcement nor a separation barrier along the lengths of the tracks, nor do they make the door a wind-loadable door.

Advantageously, the door-bracing system described in the above-reference patents remedies these shortcomings, by means of a door bracing system that contains a plurality of door-stiffening column members that are installed between associated upper mounting brackets above the garage opening and lower mounting brackets affixed to the garage floor. The door bracing system also includes deflection brackets which attach the door panel hinge joints to the column members, so that the entire vertical extent of the garage door is effectively braced against high velocity winds, and thereby prevented from separating along the guide tracks.

Problems Of The Prior Art

Although the inventions described in U.S. Pat. Nos. 5,620,038; 5,964,269 and 6,082,431 represented a significant advancement over the prior art, each of those patents required that the vertical supports mount to the building housing the garage door above the top of the garage door opening. This made it less convenient to use with a roll type garage door without extraordinary efforts. Further, each of those patents require the replacement of hinge pins with longer ones used to connect the panels of the garage door to the vertical supports. Further, there is a lack of flexibility of location in positioning the vertical supports. Further, the top connection of the vertical supports were bolted to the building, which made them difficult to remove once the threat of a hurricane passed. Thus, installation and removal is more difficult.

Further, when a vertical support was placed in between the tracks for the garage door, there was not a positive connection which would protect against both positive and negative air pressure surges.

Finally, the prior art did not allow easy assembly and shipping to a customer in a kit form for do-it-yourself installation.

BRIEF SUMMARY OF THE INVENTION

The invention is directed to apparatus and techniques for bracing garage doors against hurricane force winds which overcome the problems of the prior art. More specifically, the invention is directed to:

Apparatus for bracing roll down doors of a building having a plurality of substantially horizontal door panels, against severe winds, comprising:

a. a horizontal cross bar mounted to the building at connector locations on either side of the door panels;
b. at least one vertical support bar connected to the horizontal cross bar at a location intermediate to the ends of the horizontal cross bar and secured to the floor using a floor mount;
c. at least one attachment mechanism for connecting the vertical support bar to a panel of the roll down door.

The attachment mechanism comprises a rotatable hook.

The attachment mechanism comprises a bracket having a channel for receiving the rotatable hook mounted to a door panel.

The bracket comprises front and back pieces secured to the door panel through openings in the door panel.

The vertical support bar is connected to the horizontal cross bar using a bracket which substantially surrounds the vertical support bar and surrounds the sides and top portion of the horizontal cross bar.

The vertical support bar comprises telescoping sections, each having a rectangular cross section with T channels extending the length of the vertical support bar.

Bolts are used to secure a channel slide piece to the vertical support bar with the heads of the bolts inserted into a T channel and in which nuts are screwed onto the bolts and tightened to secure the channel slide piece to the vertical support bar at a selected location.

Another bolt extends through a portion of the channel slide piece to secure a rotatable hook to the channel slide piece.

The horizontal cross bar is mounted to the building at a connector location using at least one L bracket of common design.

A single L bracket may be bolted to a wood, concrete or steel plate on one face and secures the horizontal cross bar to the other face using a U shaped connector.

Two L brackets may be bolted to a wood, concrete or steel plate on opposite sides of the plate and both L brackets secure the horizontal cross bar to the other faces using a U shaped connector passing through both brackets.

The horizontal cross bar is placed between the other faces of the L brackets and is held in place using a U shaped connector passing through both brackets.

Two L brackets may be bolted to a wood, concrete or steel plate on the same side of the plate and in which the horizontal cross bar is placed between the other faces of the said L brackets and is held in place using a U shaped connector passing through both brackets.

One face of a first L bracket may be mounted to a first vertical surface with the other face lying on a horizontal surface, and a second L bracket may be mounted to a second vertical surface below the horizontal surface with the second face of the second bracket being parallel the other face of the first bracket.

The horizontal cross bar may be mounted between the other face of the first L bracket and the second face of the second L bracket.

Two L brackets may be used, in which the first L bracket is bolted to a wood, concrete or steel plate on one face and secures the horizontal cross bar to the other face using a U shaped connector, and a second L bracket is connected to a mounting support for a roll of panels for the garage door horizontally displaced from the first L bracket and in which one end of the first L bracket is attached to the second L bracket using a small bracket.

The invention is also directed to a method for bracing roll down doors of a building having a plurality of substantially horizontal door panels against severe winds, comprising:

a. mounting a horizontal cross bar to the building at connector locations on either side of the door panels;

b. providing at least one vertical support bar connected to the horizontal cross bar at a location intermediate to the ends of the horizontal cross bar and secured to the floor using a floor mount;

c. connecting the vertical support bar to at least one panel of the roll down door using an attachment mechanism.

The attachment mechanism in the method comprises a bracket having a channel mounted to a door panel for receiving a rotatable hook.

The invention is also directed to a kit for bracing roll down doors of a building having a plurality of substantially horizontal door panels against severe winds, comprising:

a. a plurality of L brackets;

b. one horizontal cross bar;

c. at least one vertical support bar;

d. a floor mounting bracket; and e. at least one bracket for substantially surrounding a vertical support bar and for engaging said horizontal cross bar.

The at least one vertical support bar in the kit may be a telescoping vertical support bar.

The at least on vertical support bar of the kit has a substantially rectangular cross section with at least one T channel extending the length of the vertical support bar.

The kit further comprises at least one bracket for attaching to a door panel and a rotatable hook for rotating into engagement with the bracket and connecting to the vertical support bar.

DETAILED DESCRIPTION OF THE INVENTION

Figure 1A:
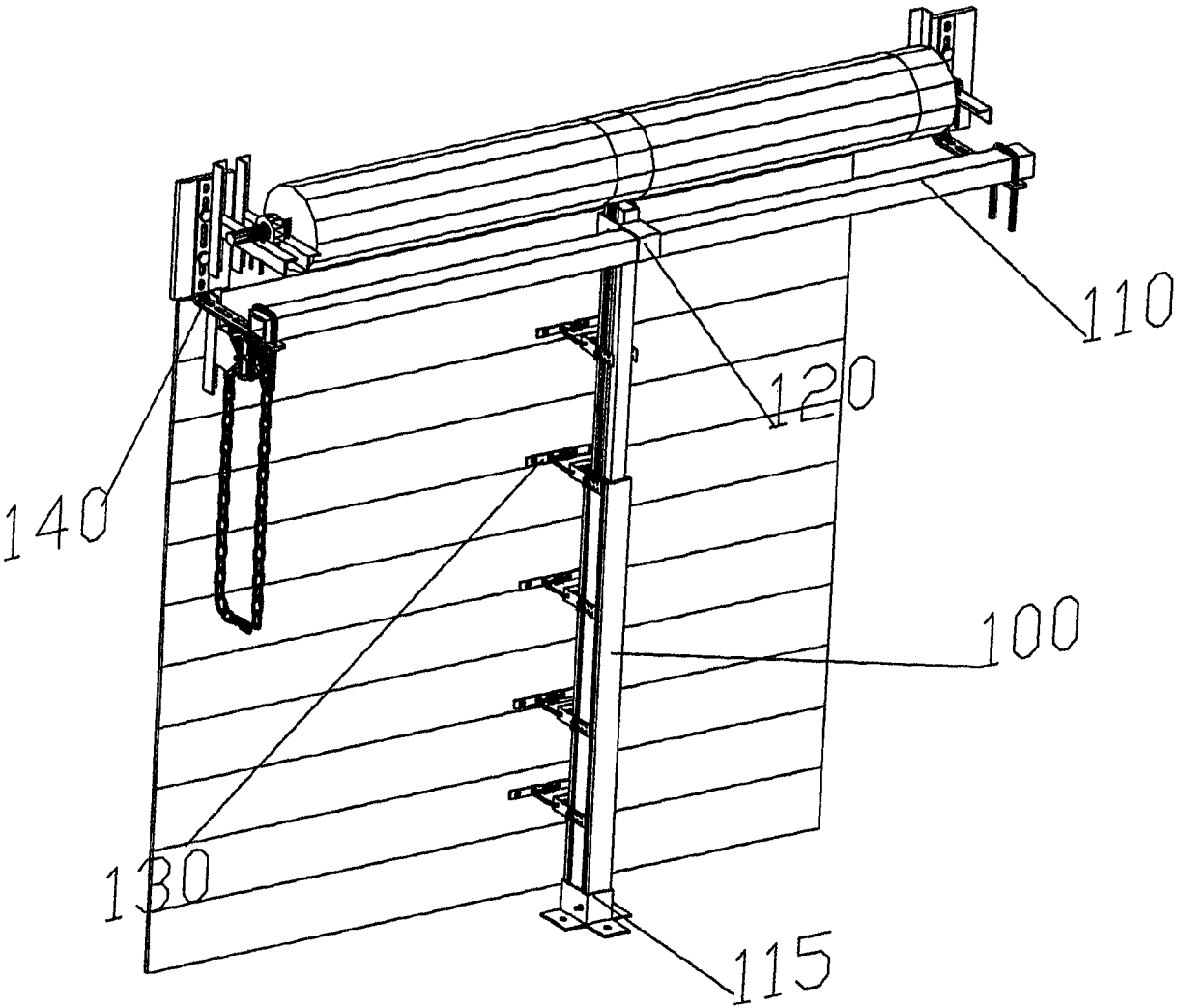
FIGS. 1A, 1B, and 1C are perspective views of a single, double and triple vertical support for respective, single, double and triple wide garage doors in accordance with one aspect of the invention.

FIG. 1A shows a perspective view of a single vertical support for a singlewide garage door in accordance with one aspect of the invention. The telescoping vertical support 100 is mounted to the floor using a mounting bracket 115 in ways that are shown in the prior art. When the vertical support is removed, the mounting bracket 115 can be removed for normal operation during a time when no hurricane is threatened. The vertical support 100 connects to a cross bar 110 using a bracket 120, described more hereinafter. The vertical support is connected to at least one panel of the garage door using bracket 130, as described more hereinafter. The horizontal cross bar 110 is mounted to the wall of the building using one or more brackets as described more hereinafter.

Figure 1B:
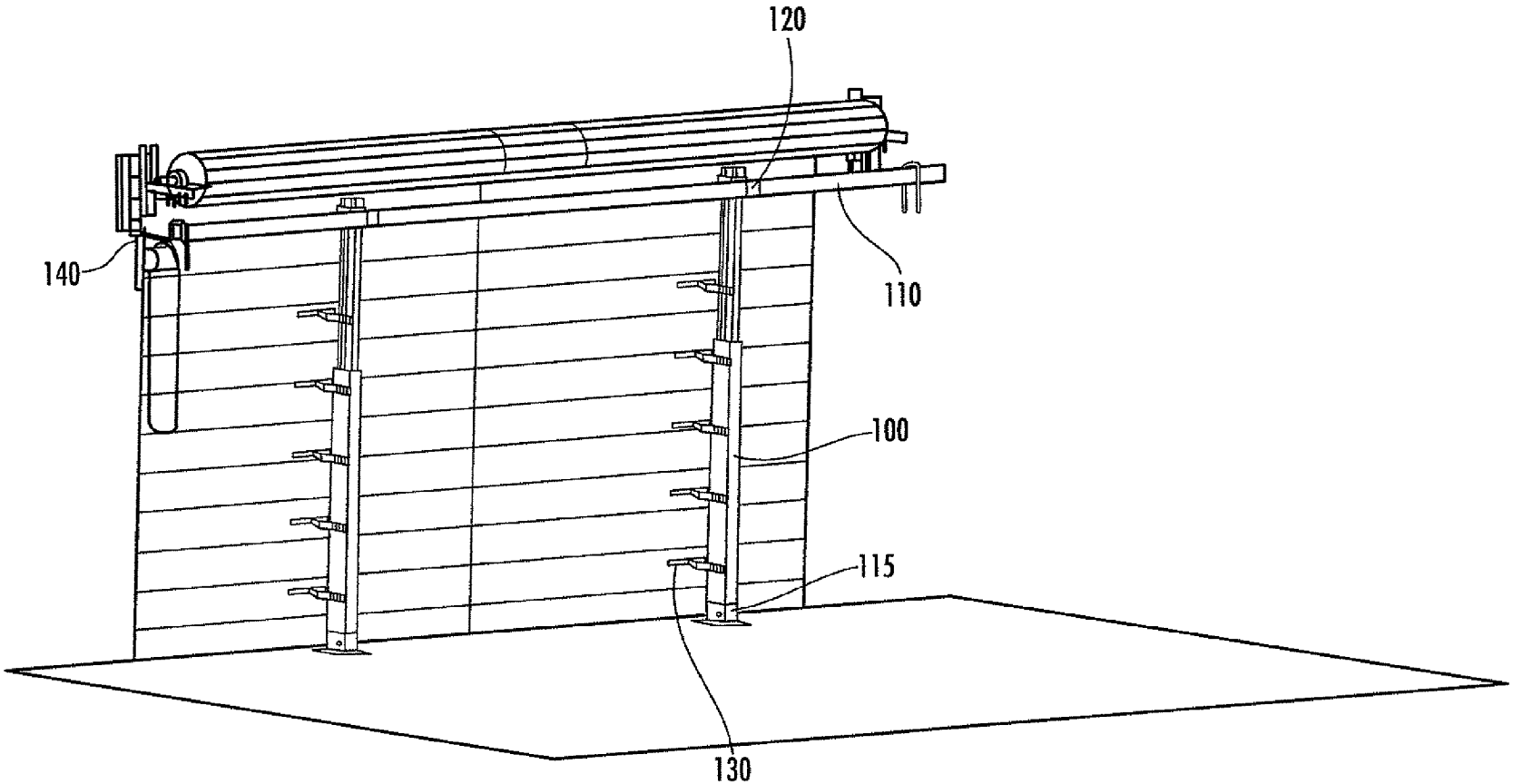
Figure 1C:
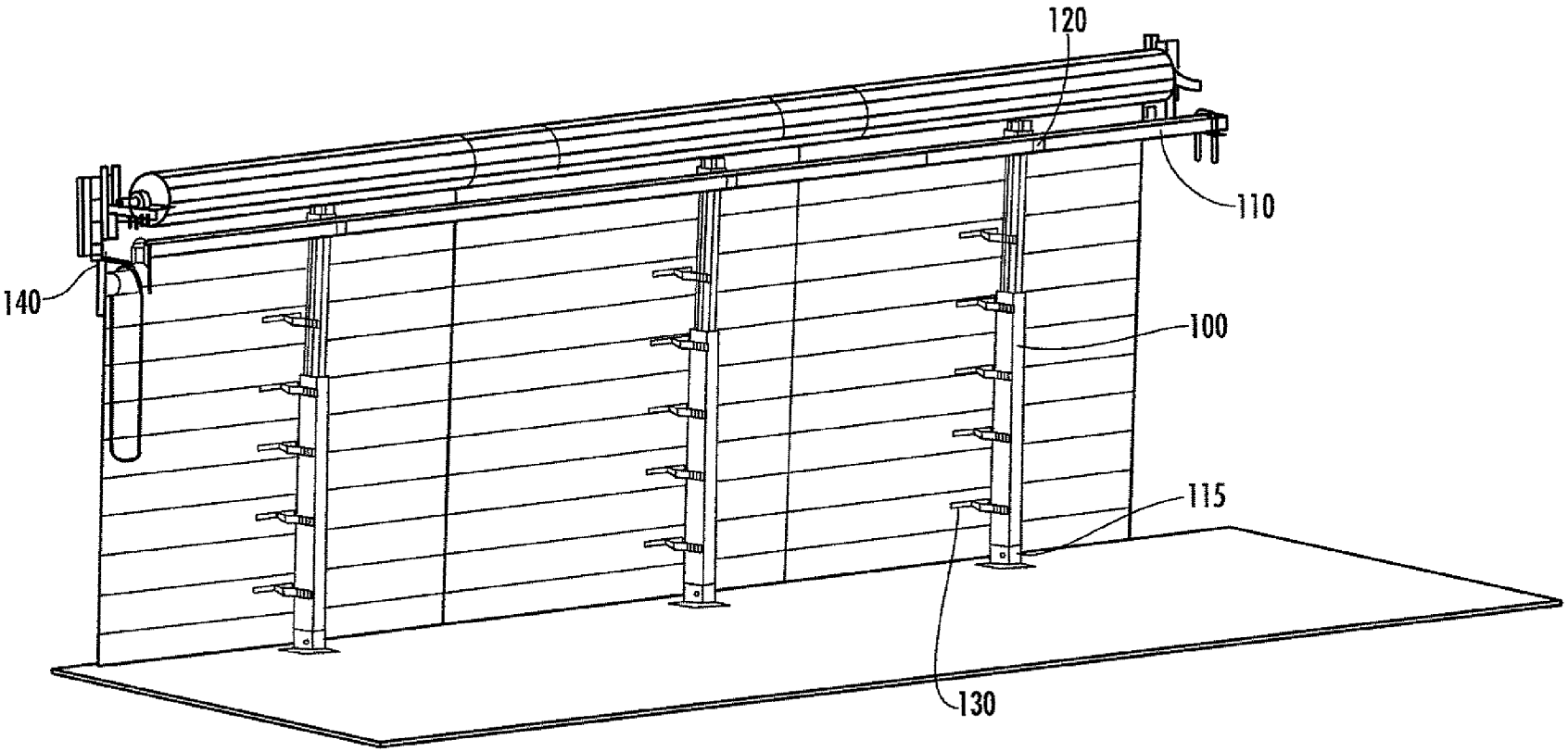

FIGS. 1B and 1C show perspective views of a double and triple vertical support for double and triple wide garage doors in accordance with one aspect of the invention. In each of these figures, the vertical support 100 is replicated two or three times to accommodate the size of the garage doors.

Figure 2:
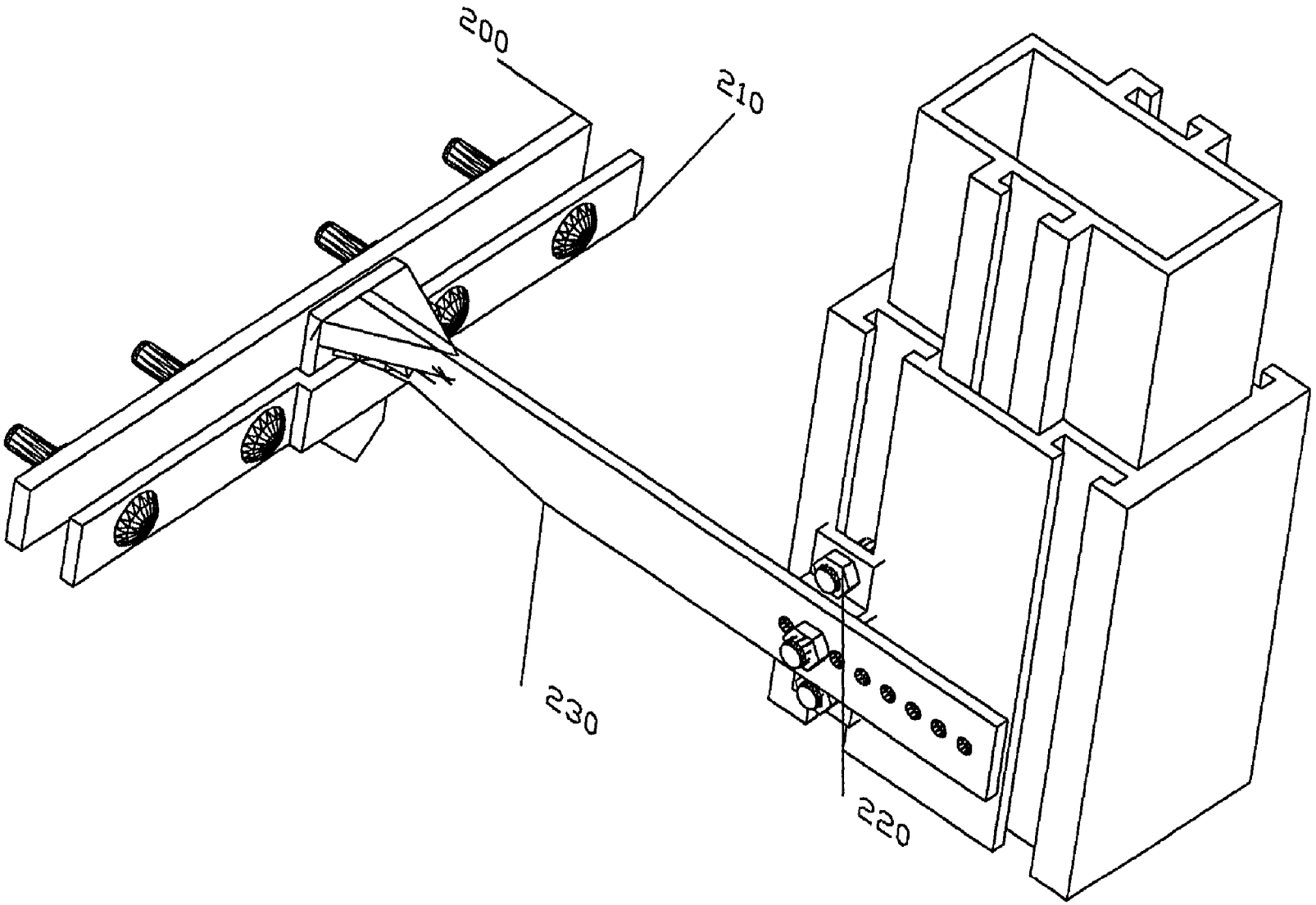
FIG. 2 shows a perspective view of hardware used to attach a telescoping vertical support to the garage door in accordance with one aspect of the invention.

FIG. 2 shows a perspective view of hardware used to attach a telescoping vertical support to the garage door in accordance with one aspect of the invention. Depiction of the thickness of the garage door is not illustrated to permit a view of the mounting of the brackets to the garage door to be visualized more readily. The mounting to the garage door occurs using a rear bracket 200 and a front bracket 210. The two brackets are positioned on opposite sides of a panel thickness for the garage door and are sized so as to permit the panel of the garage door to roll up and be stored in its usual fashion. Bracket 210 has a U channel, described more hereinafter. A channel slide 220 fits into the T channel on the vertical support and can be moved into position and then secured by tightening the nuts associated with the bolt, the bolt head of which rides in the channel. A third bolt, extending from the channel slide is utilized to mount a hook 230, the point of which fits into the U channel of the front bracket 210 of the door mounting brackets.

Figure 3:
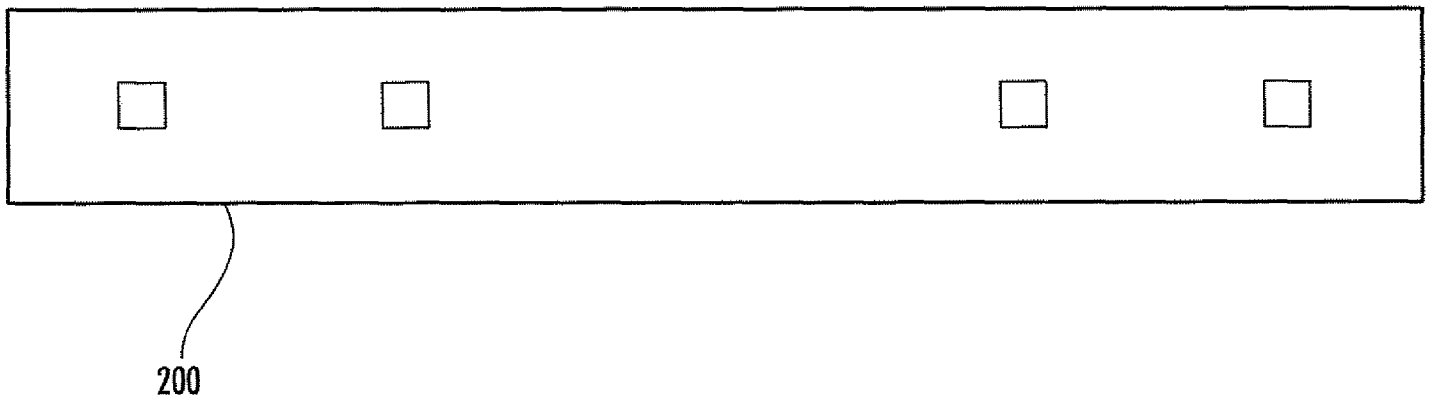
FIG. 3 illustrates a backside piece for attachment to a garage door panel.

FIG. 3 illustrates a rear bracket piece 200 of a door-mounting bracket for attachment to the garage door panel. The material for the bracket is ⅛ GA steel.

Figure 4:
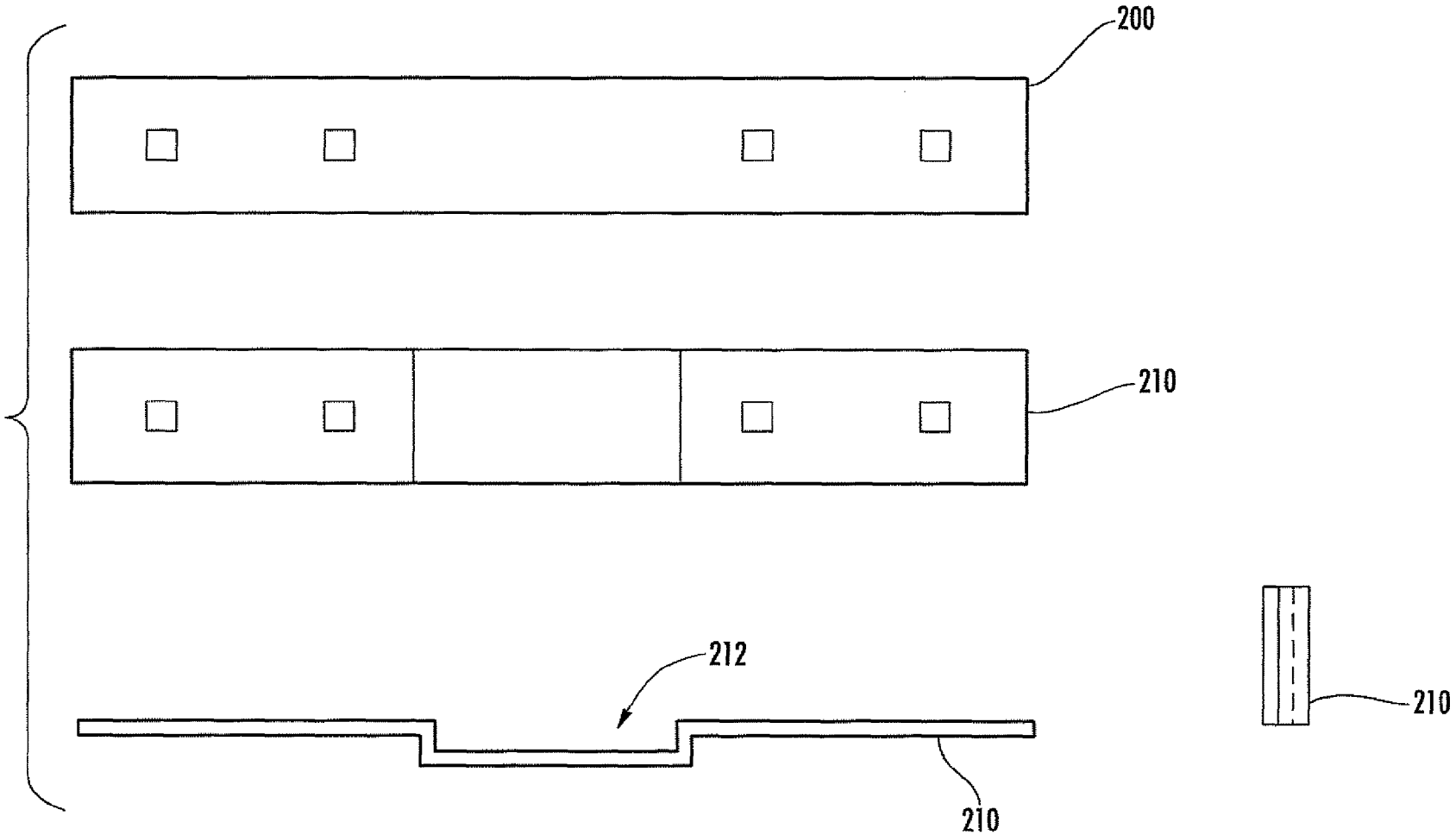
FIG. 4 illustrates a front side piece having a U shaped channel for attachment to a garage door panel.

FIG. 4 illustrates the front bracket 200 having a U shaped channel 212 for attachment to the garage door.

Figure 5:
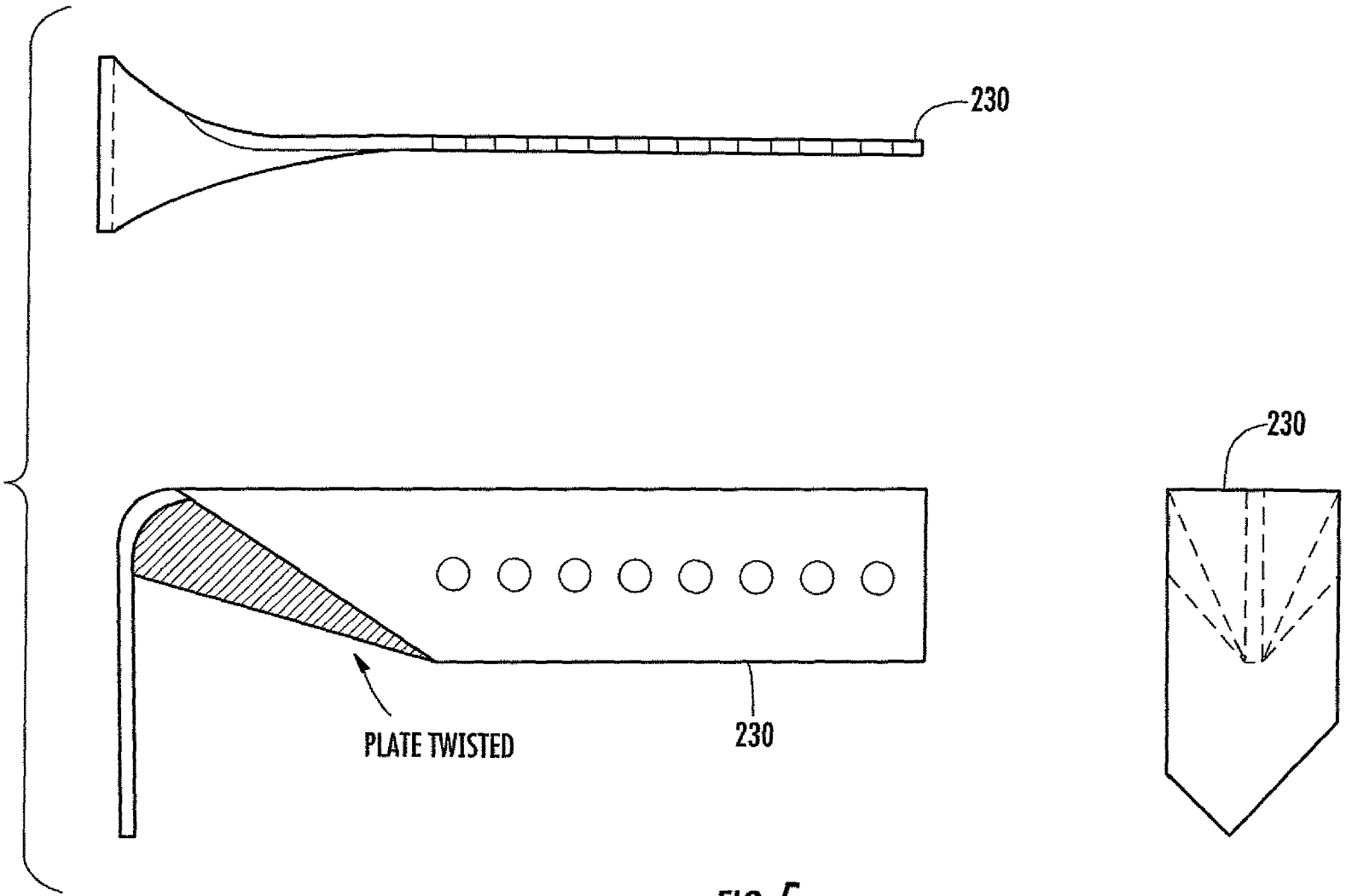
FIG. 5 illustrates a hook piece that rotates to fit into the U shaped channel of FIG. 4 to connect the door to the telescoping vertical support.

FIG. 5 illustrates a hook piece 230 that rotates to fit into the U shaped channel 212 of FIG. 4 to connect the door mounting brackets to the telescoping vertical support 100.

Figure 6:
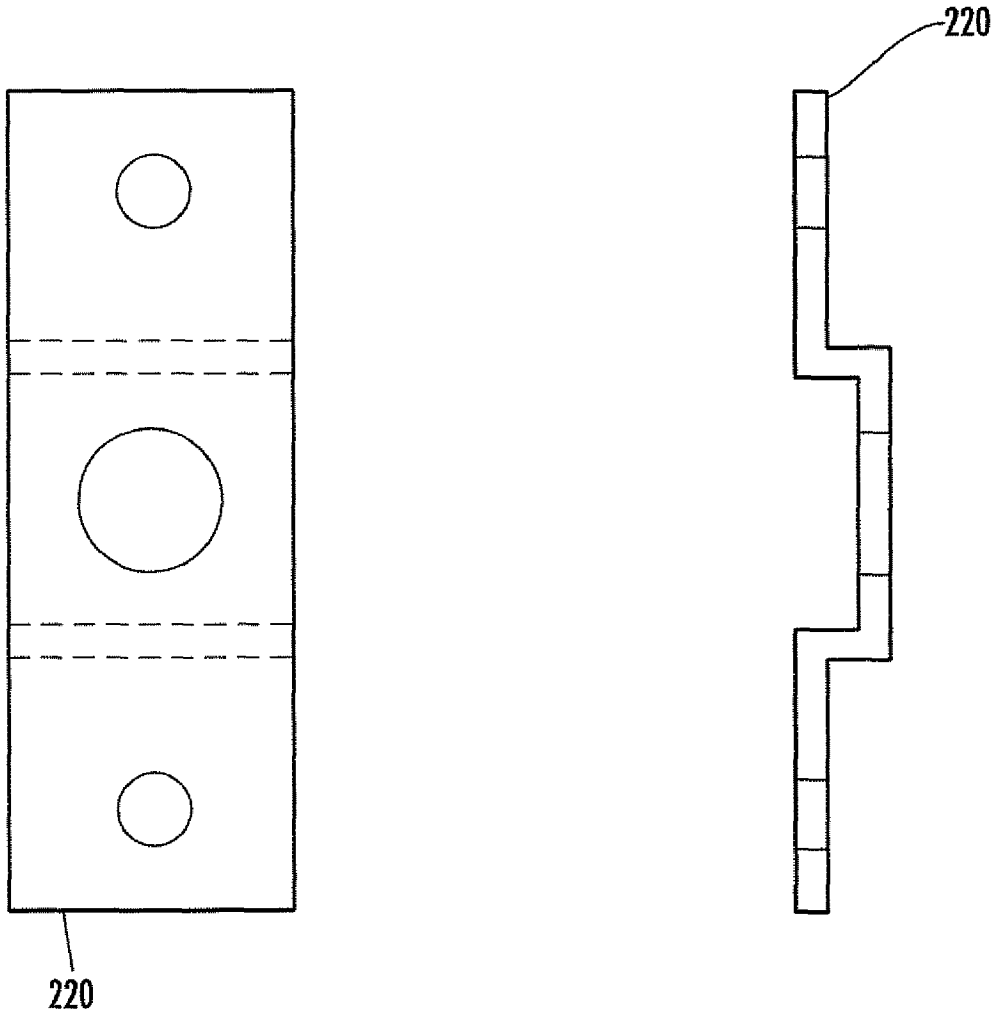
FIG. 6 illustrates a channel slide piece that can be adjusted vertically in a T channel track of a vertical support.

FIG. 6 illustrates the details of the construction of a channel slide piece 220 that can be adjusted vertically in a track of a vertical support 100.

Figure 7:
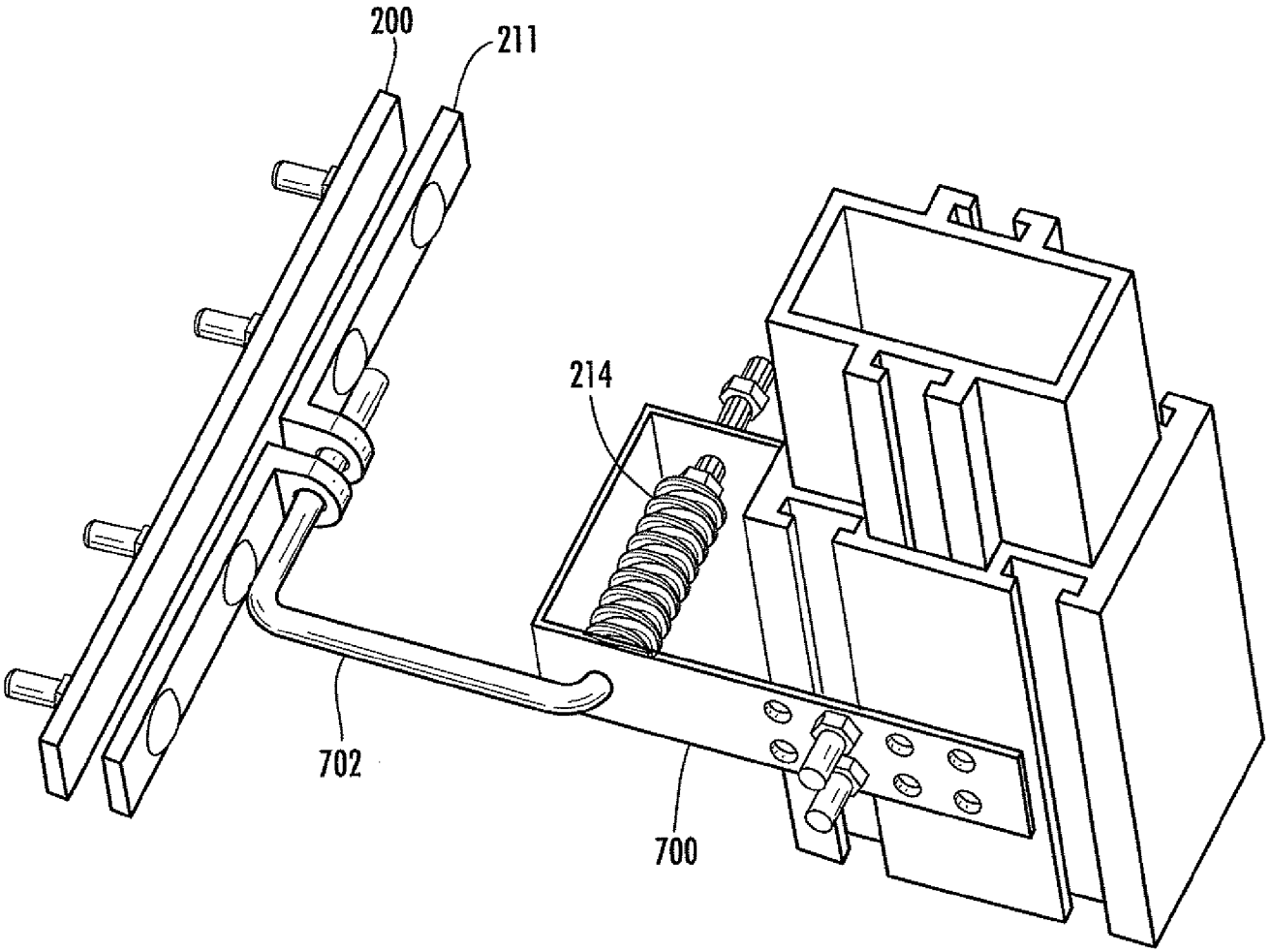
FIG. 7 illustrates an alternative technique for connecting the garage door to the vertical support.

FIG. 7 illustrates an alternative technique for connecting the garage door to the vertical support. In this case, a bracket 700 is mounted to the vertical slide using the bolt heads to guide the bracket positioning of the bracket in the T channel of the vertical support. The bracket 700 is configured to receive and mount a spring-loaded J channel 702 which can be inserted into the holes of the front side door mounting brackets 211 of slightly modified construction shown in FIG. 7. To remove the J channel 702, the channel is pulled to the left until it clears the holes and then it can be released to be held in place by the spring 214 for use when it is installed at a later time. The spring 214 keeps the J channel 702 out of the way when the vertical supports are stored when no hurricane threat is present.

Figure 8:
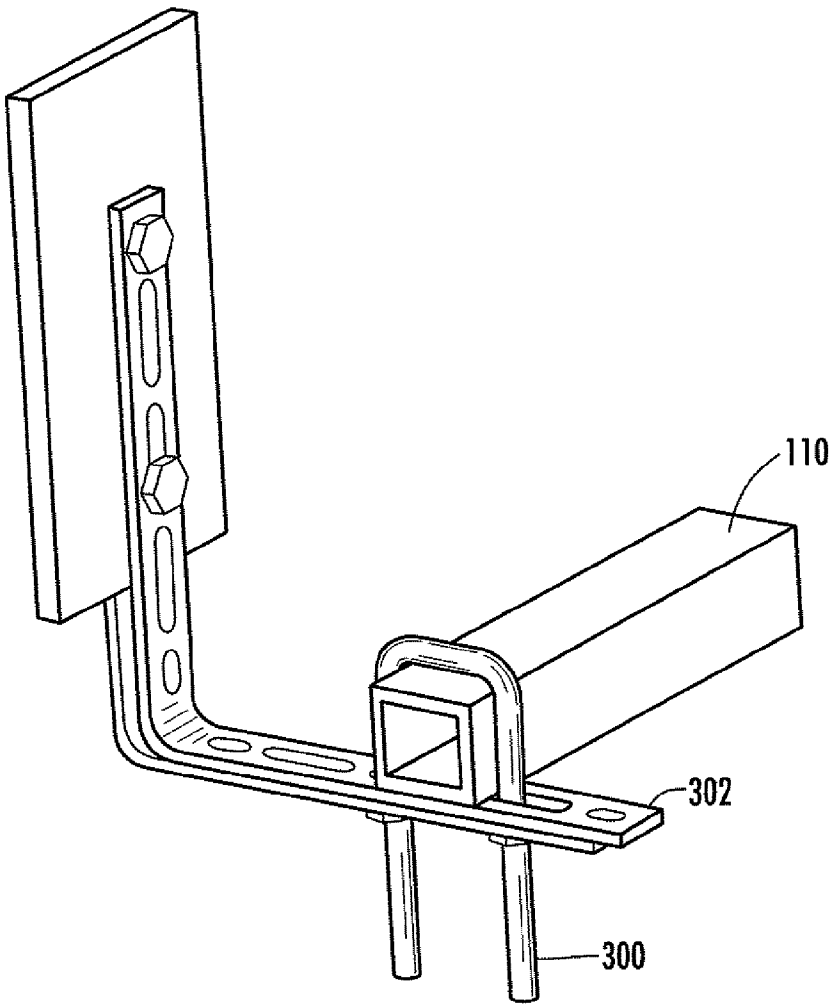
FIG. 8 illustrates a first technique for mounting the horizontal cross bar shown in FIG. 1 to the building.
Figure 9:
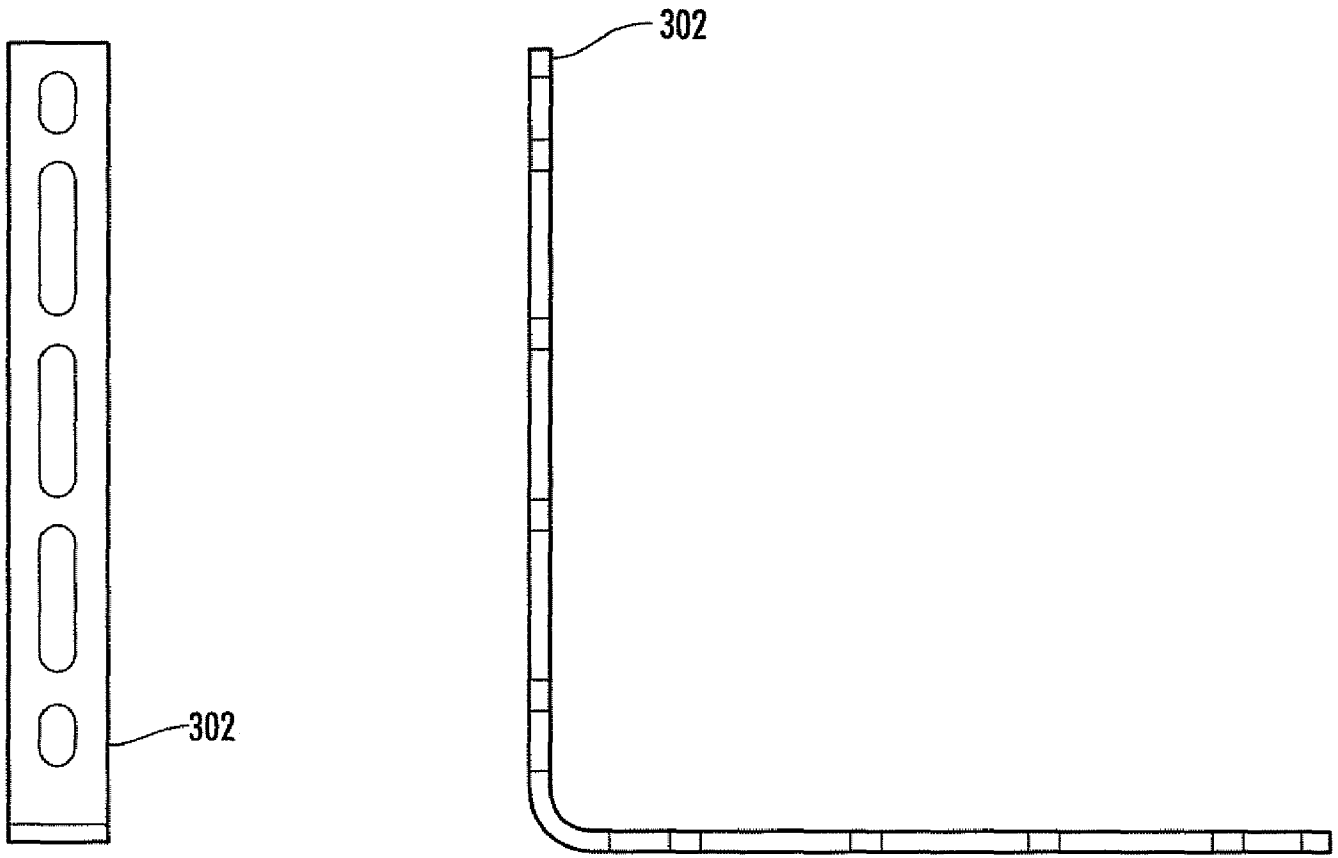
FIG. 9 shows details of the L bracket illustrated in FIG. 8.

FIG. 8 illustrates a first technique for mounting the horizontal cross bar 110 shown in FIG. 1A to the building. As shown, the horizontal cross bar is held in place by a U channel 300 inserted through the lower portion of an L bracket 302, the vertical portion of which is mounted to a wood, concrete or steel plate securely fastened to the building. The details of the L bracket 302 illustrated with FIG. 8 are shown in FIG. 9.

Figure 10:
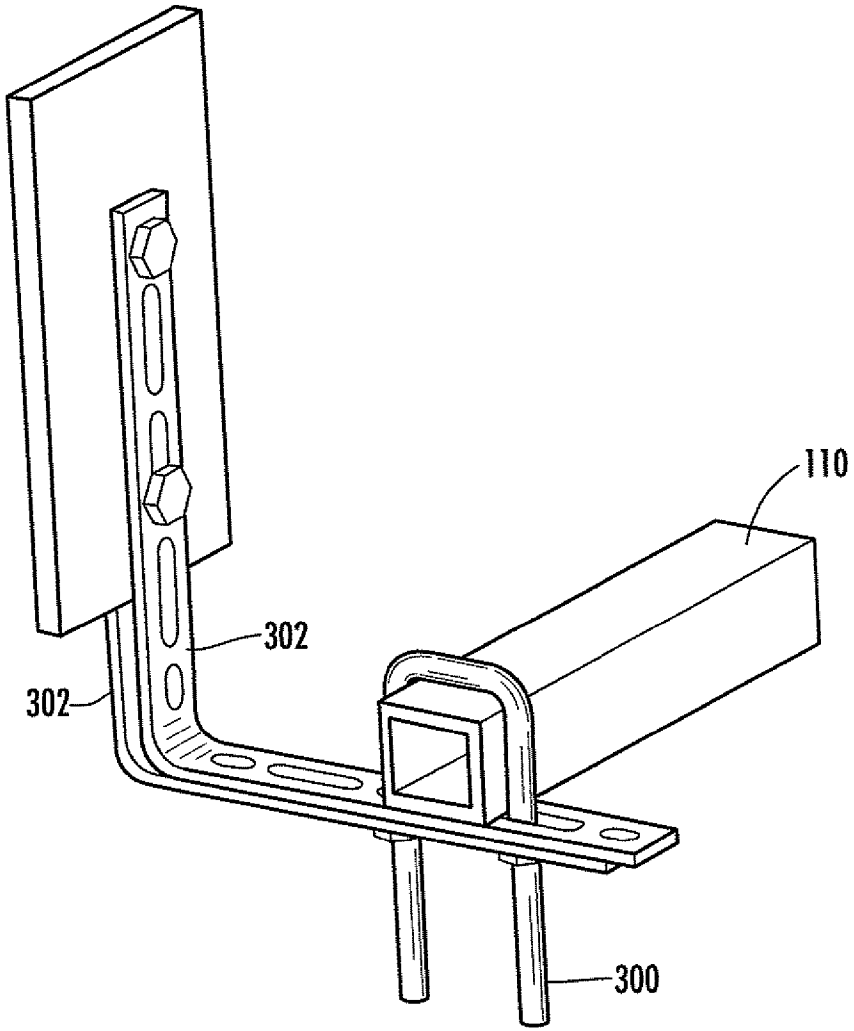
FIG. 10 shows a second technique for mounting the horizontal cross bar to the building.

FIG. 10 shows a second technique for mounting the horizontal cross bar 110 to the building. This technique uses two L brackets 302, one on either side of a plate to provide additional strength.

Figure 11:
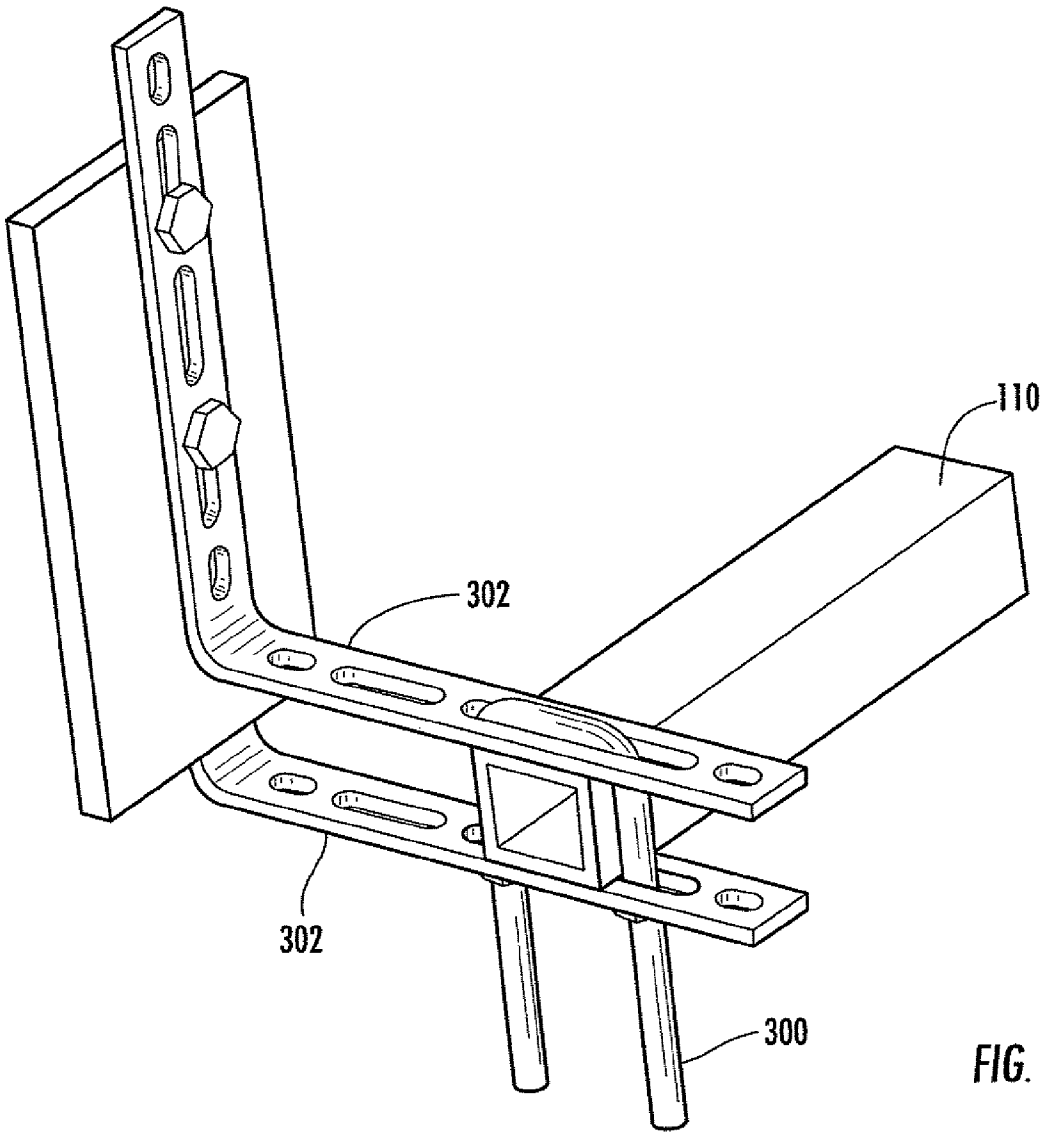
FIG. 11 shows a third technique for mounting the horizontal cross bar to the building.

FIG. 11 shows a third technique for mounting the horizontal cross bar 110 to the building. This technique also utilizes two L brackets 302 with the bottom piece of each L bracket being on opposite sides of the channel cross bar.

Figure 12:
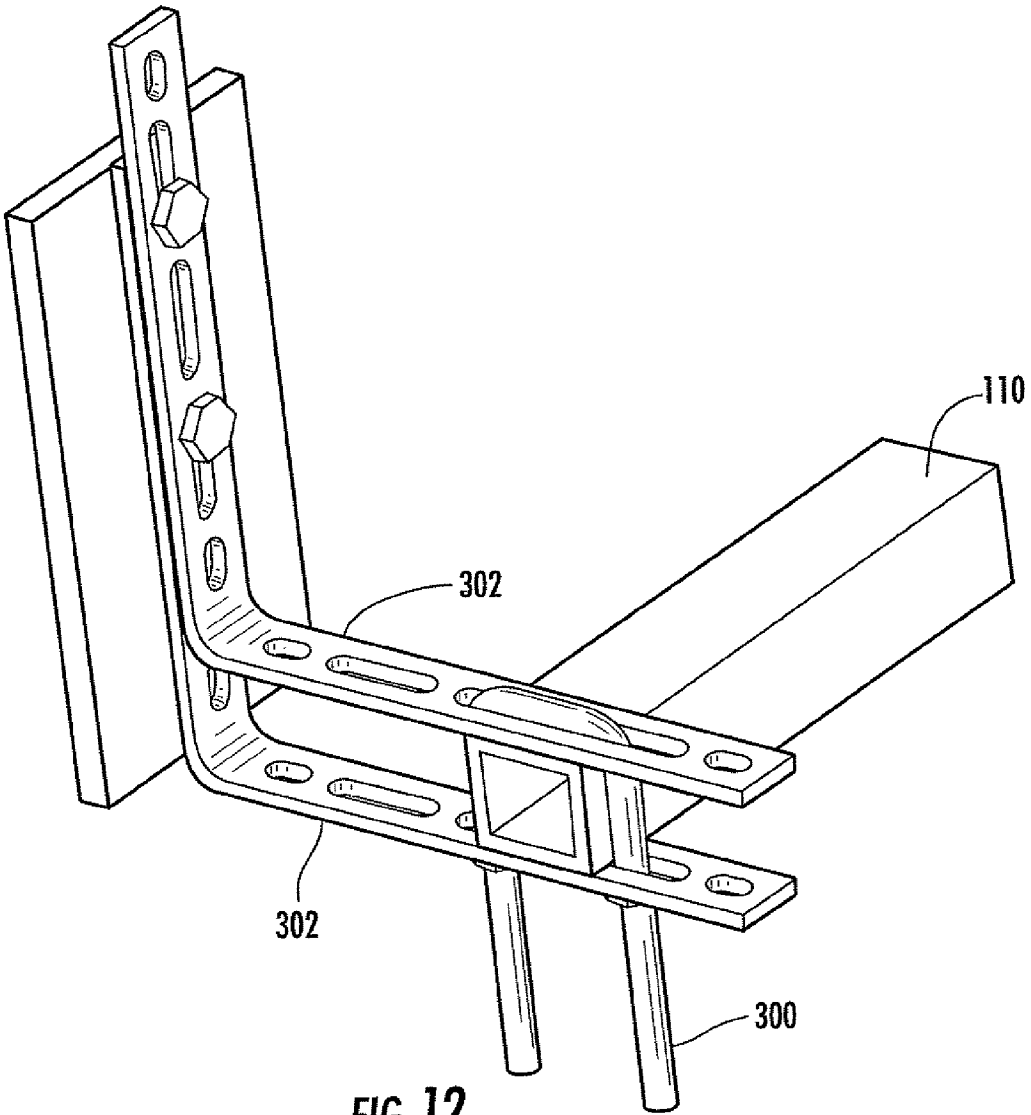
FIG. 12 shows a fourth technique for mounting the horizontal cross bar to the building.

FIG. 12 shows a forth technique for mounting the horizontal cross bar 110 to the building. This figure is like FIG. 11, except that both L brackets 302 are mounted on the same side of the mounting plate.

Figure 13:
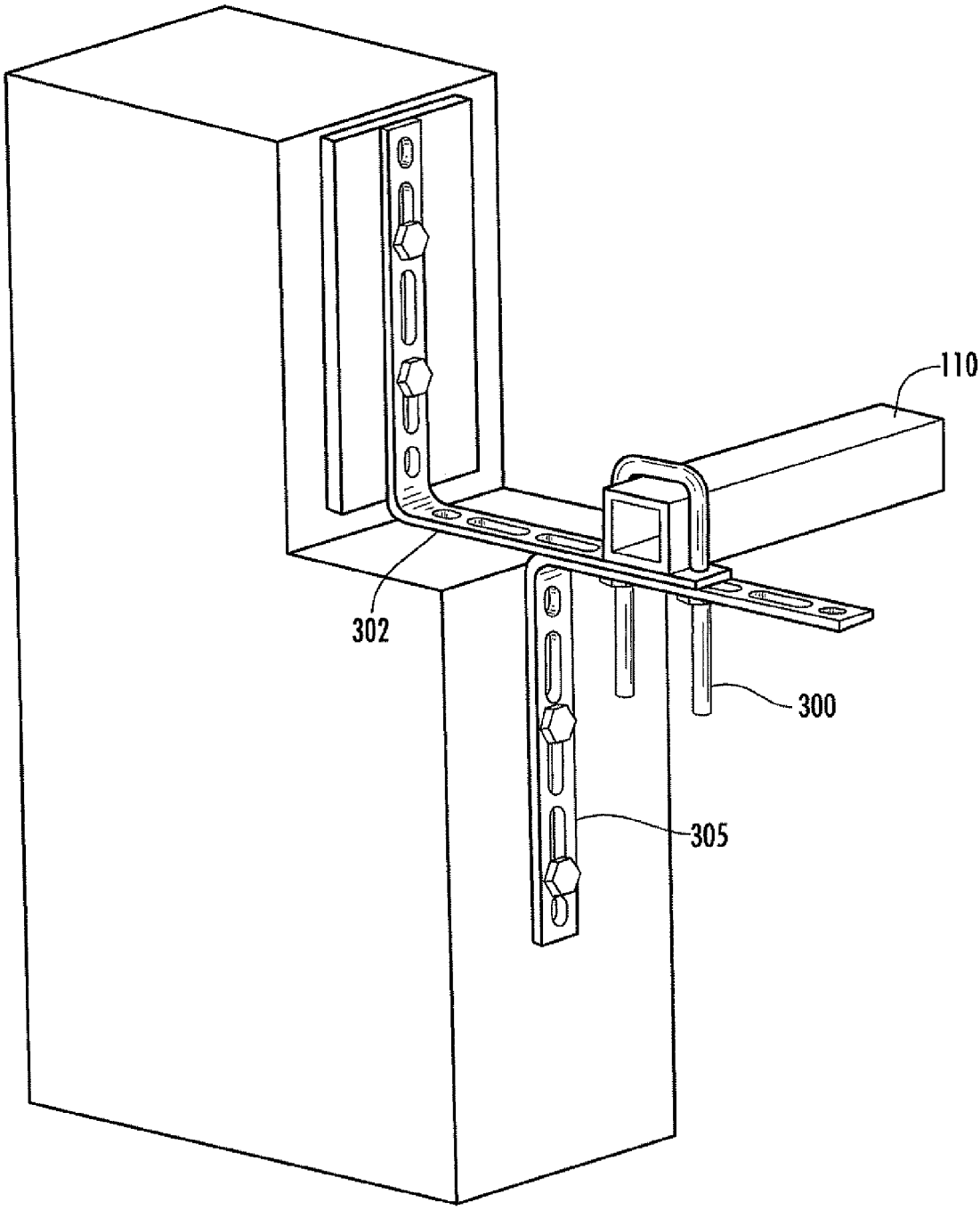
FIG. 13 shows a fifth technique for mounting the horizontal cross bar to the building.

FIG. 13 shows a fifth technique for mounting the horizontal cross bar 110 to the building. In this case, one L bracket 302 is utilized to mount to a plate against one portion of the building and a second L bracket 305, mounted below, accommodates the step nature of the building construction at the point of attachment.

Figure 14:
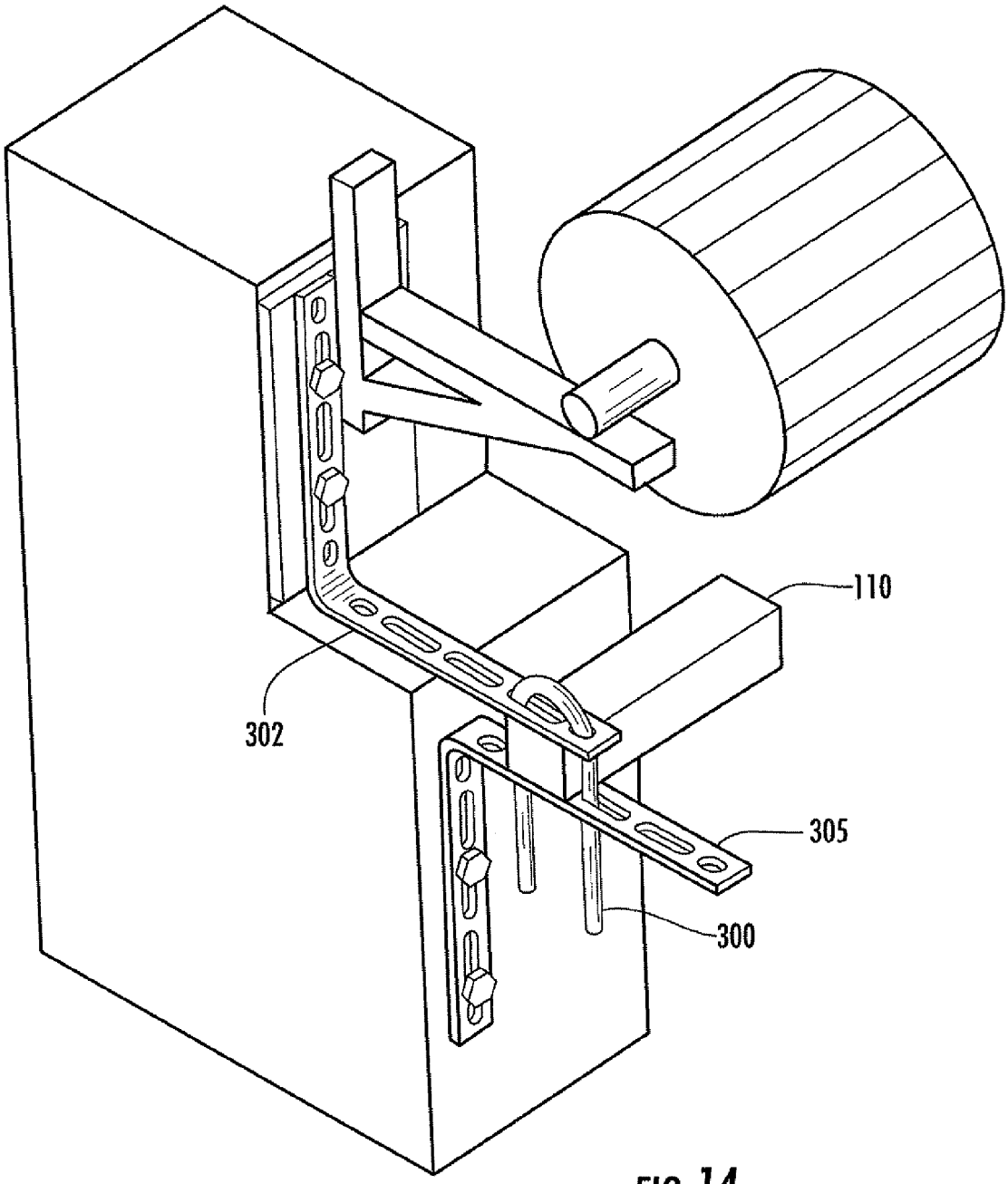
FIG. 14 shows a sixth technique for mounting the horizontal cross bar to the building.

FIG. 14 shows a sixth technique for mounting the horizontal cross bar 110 to the building. Again, there is a step displacement which can be utilized effectively by mounting two L brackets 302 and 305, one above and one below the cross bar position.

Figure 15:
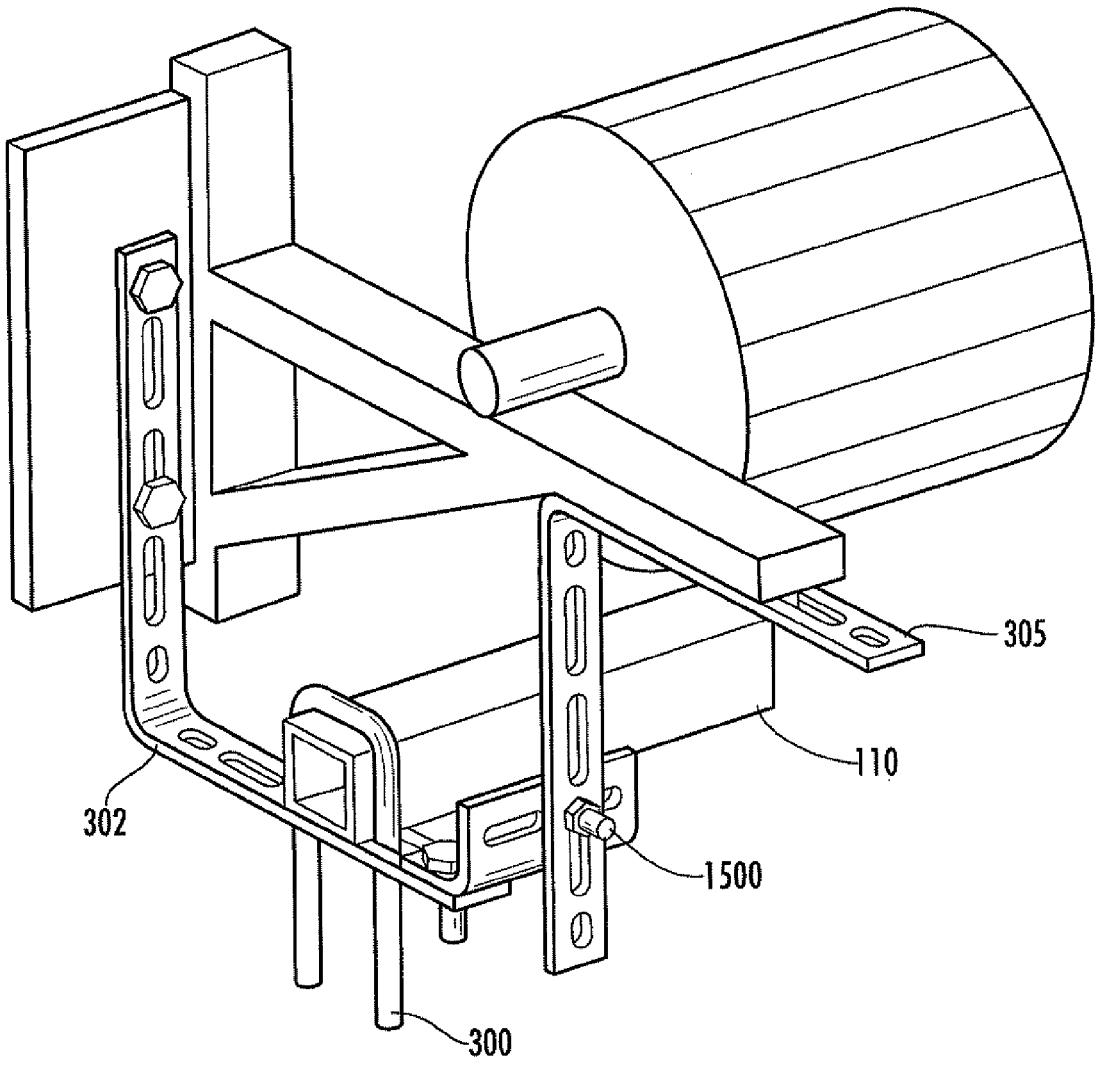
FIG. 15 shows a seventh technique for mounting the horizontal cross bar to the building.

FIG. 15 shows a seventh technique for mounting the horizontal cross bar 110 to the building. In this case, this technique is similar to that shown in FIG. 8 except that a small bracket 1500 is utilized to displace an L bracket 305 so that it can attach underneath the bracing to which the roll for the garage door panels is mounted. This allows yet added strength.

Figure 16:
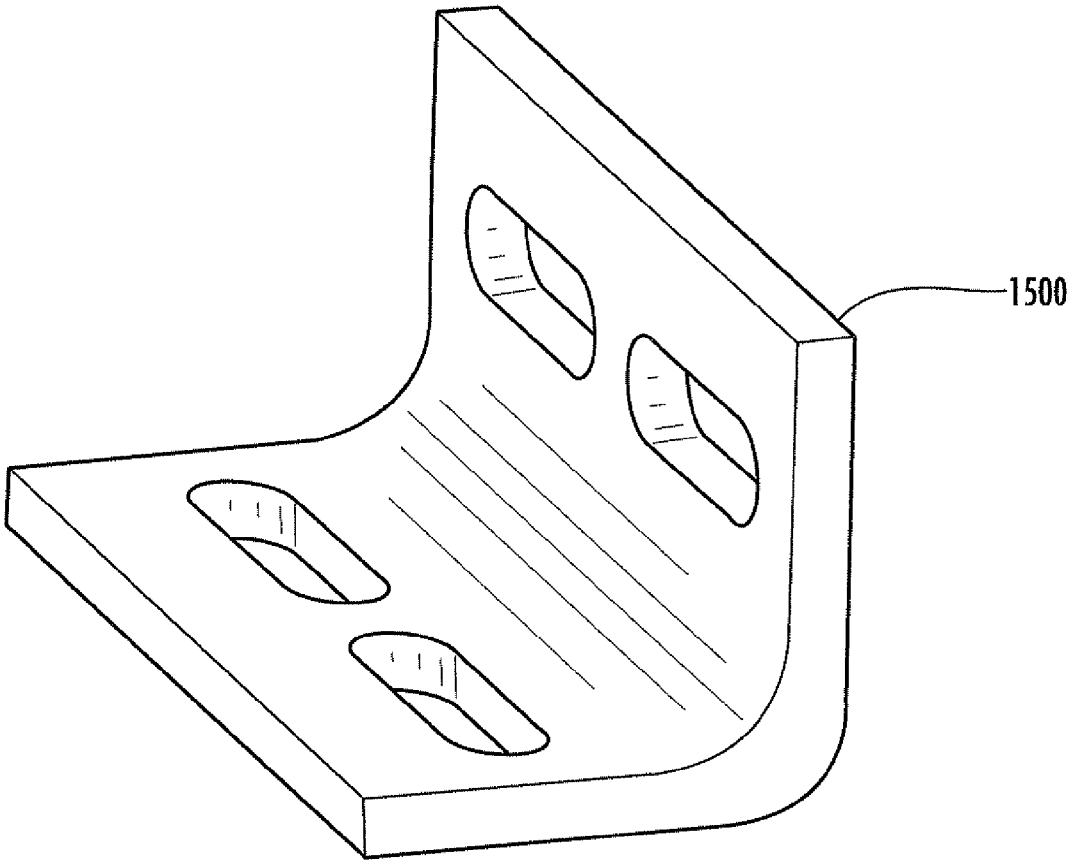
FIG. 16 is a perspective view of a small bracket used in the mounting arrangement of FIG. 15.

FIG. 16 is a perspective view of a small bracket 1500 used in the mounting arrangement of FIG. 15. Each of the techniques for mounting the horizontal cross bar to the building shown in FIGS. 8-15, utilize the same L bracket. That is, the construction of the L bracket is such as to accommodate a variety of configurations and mountings. This allows a single piece to have multiple uses and to reduce the number of pieces that might need to be stored or fabricated for an installation by homeowner in a do-it-yourself installation.

Figure 17:
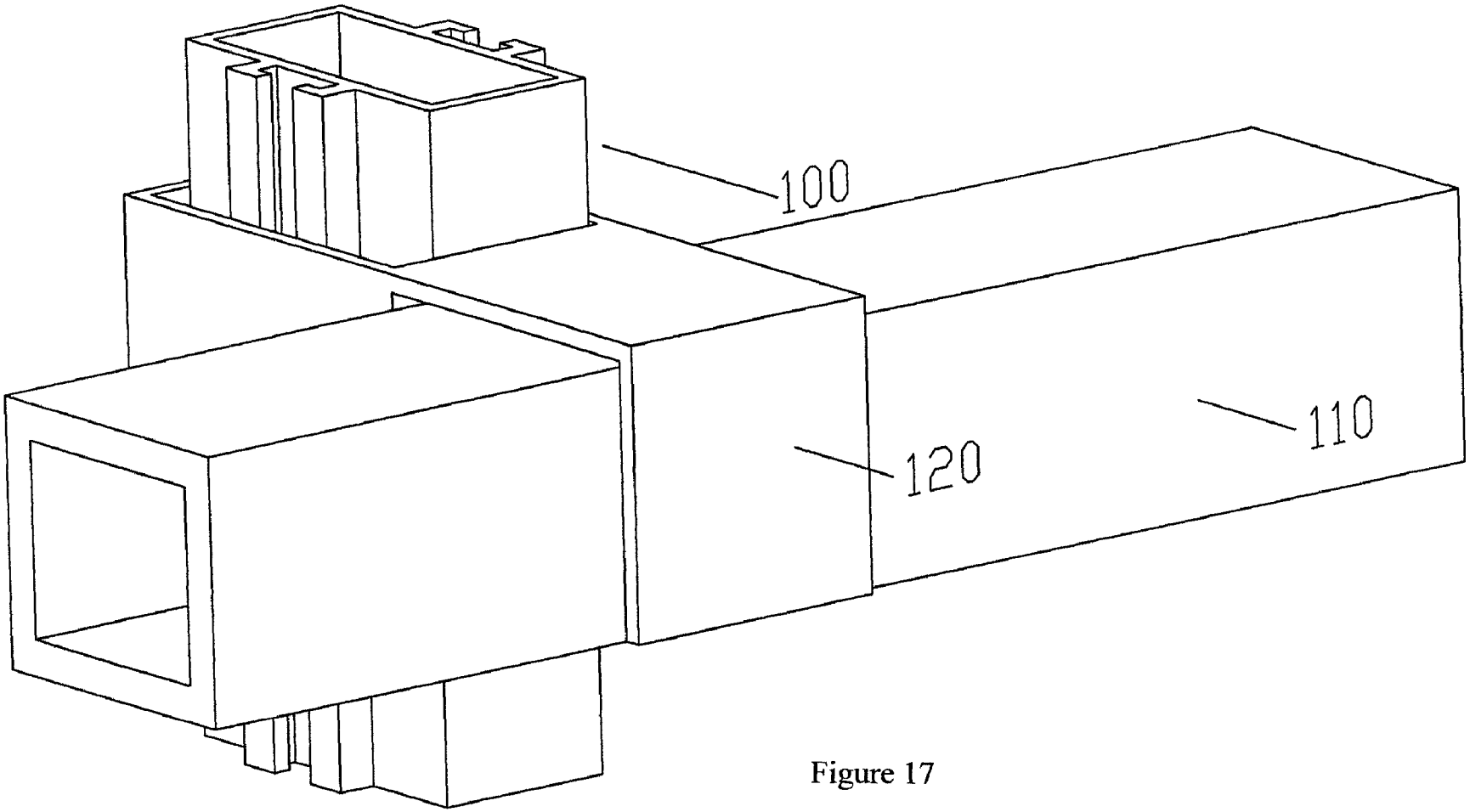
FIG. 17 is a perspective view of an assembly showing how to connect a vertical support to the horizontal cross bar shown in FIGS. 1A, 1B and 1C in accordance with one aspect of the invention.

FIG. 17 is a perspective view of an assembly showing how to connect a vertical support to the horizontal crossbar shown in FIGS. 1A, 1B and 1C.

Figure 18:
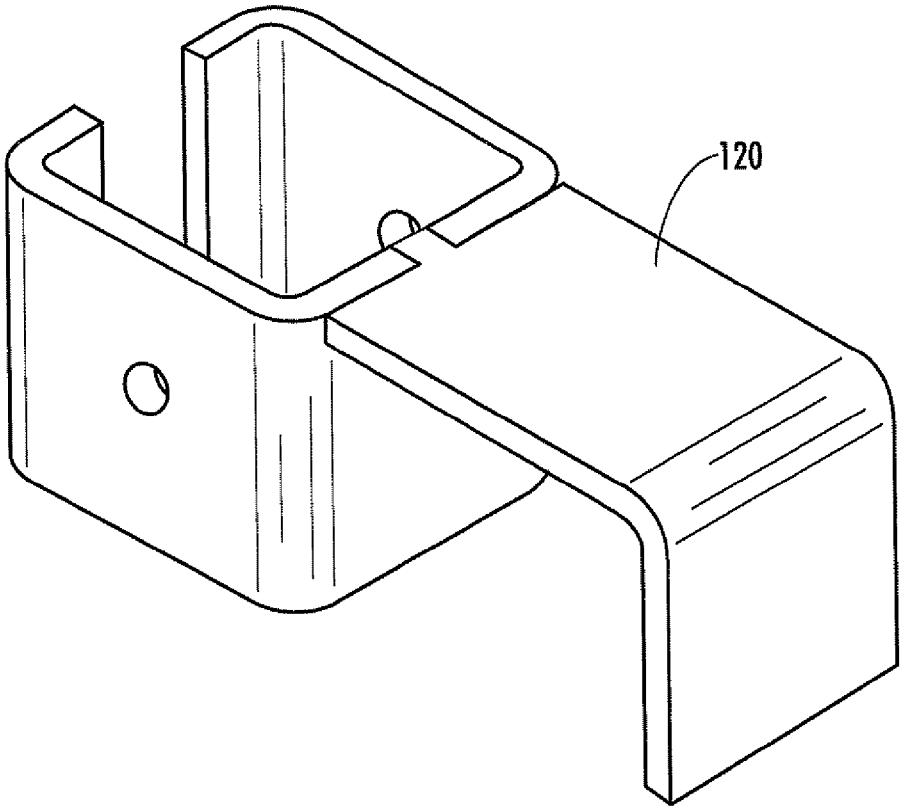
FIG. 18 is a perspective view of the bracket used in FIG. 17.

FIG. 18 provides a perspective view of the bracket 120 used in the attachment of FIG. 17.

Figure 19:
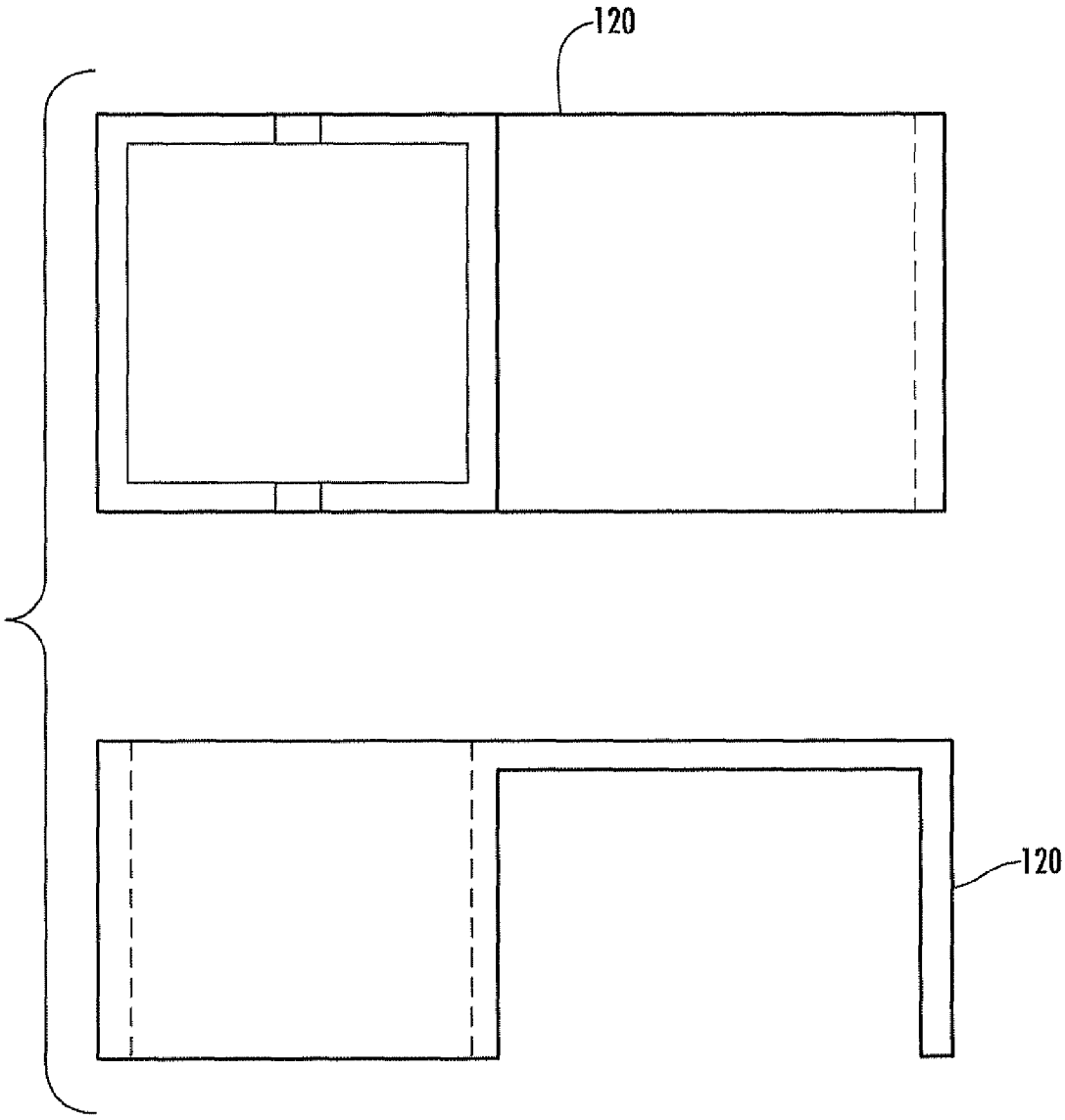
FIG. 19 is a detailed view of a preferred version of the bracket shown in FIG. 18.

FIG. 19 provides a detailed view of a preferred version of the bracket 120 shown in FIG. 17.

Returning to FIG. 17, one can see that the bracket and the mounting bolt locations are configured so that the head of the mounting bolts can slide in the T channels of the vertical support, allowing it to be adjustable up and down the vertical support.

Turning again to FIG. 1A, the vertical cross bar (s) the horizontal cross bar, the L brackets for mounting, the door mounting brackets 130 can be conveniently packed and shipped as a kit for easy installation by a homeowner, authorized dealer or contractor. Once installed, the vertical supports can be easily removed by disconnecting the hook from each of the door panel mounting brackets and by sliding the vertical brace 100 on crossbar 110 to either side of the horizontal bar to be secured to the side wall or by lifting the bracket 120 attached to the vertical support 100 so that the top of the bracket 120 clears the horizontal cross bar so that it can be removed and stored. The floor bracket is fastened to the vertical brace and moves with the vertical brace. Push rods can be used to slide into 2 predrilled holes thru a plate fastened in the floor. This plate will remain in the floor and can be driven over etc. Thus, with the L brackets and the cross bar in place, a homeowner can quickly and easily slide the rods into the floor bracket into previously drilled holes, connect or slide the vertical support(s) to or on the horizontal cross bar using bracket 120, adjust the channel slides to the corresponding heights of the U channels of the door mounting brackets and have a positive connection between the door panels and the vertical support bar that will protect the door against both positive and negative pressure. The sizing of the door mounting brackets are such that they can be accommodated in the roll up of the door panels when the door is open.

There has thus been described an extremely effective and easy to install method of protecting garage doors during a threat of a hurricane or used for security when installed to prevent the rollup door from opening. The installation as described can be done quickly, on short notice once a wind storm is threatened. Once the threat is past it can be removed and stored using a minimum of space.

The arrangement described provides easy installation even by a do-it-yourself homeowner. The arrangement described also allows itself to be shipped conveniently as a kit from a distribution point to the homeowner.

While various embodiments of the present invention have been illustrated herein in detail, it should be apparent that modifications and adaptations to those embodiments may occur to those skilled in the art without departing from the scope of the present invention as set forth in the following claims.

The invention claimed is:

1. An apparatus for bracing a roll down door of a building, the roll down door comprising a plurality of substantially horizontal door panels adjacent one another, the apparatus comprising:

a horizontal cross bar to be mounted to the building at connector locations on opposite sides of the roll down door;

at least one vertical support bar having a first end to be secured to the floor, and a second end to be secured to said horizontal cross bar, said at least one vertical support bar including at least one channel track extending along a length thereof; and at least one attachment mechanism for connecting said at least one vertical support bar to at least one of the door panels, and comprising a channel slide piece to be adjusted vertically in the at least one channel track of said at least one vertical support bar, a bracket assembly to be coupled to one of the door panels, and a hook having a rotatable end coupled to said channel slide piece, and a free end for engaging said bracket assembly.

2. The apparatus of claim 1 wherein said hook includes a plurality of adjustment openings extending therethrough along the rotatable end, and wherein said channel slide track further comprises a bolt for coupling the rotatable end of said hook to said channel slide track through a selected adjustment opening.

3. The apparatus of claim 1 wherein said bracket assembly includes a U-shaped receiving area for receiving the free end of said hook.

4. The apparatus of claim 1 wherein said bracket assembly comprises front and back pieces to be coupled together on opposite sides of one of the door panels.

5. The apparatus of claim 1 further comprising a slide bracket including an opening extending therethrough for sliding over the second end of said at least one vertical support bar, said slide bracket comprising an L-shaped extension extending outwardly therefrom for resting on an upper surface and outer adjacent edge of said horizontal cross bar.

6. The apparatus of claim 1 wherein said at least one vertical support bar comprises telescoping sections with each section having a rectangular cross section and including the at least one channel track.

7. The apparatus of claim 1 further comprising a plurality of L brackets for mounting said horizontal cross bar to the connector locations of the building.

8. The apparatus of claim 7 wherein at each connector location a single L bracket is bolted to a wood, concrete or steel plate on one face and secures said horizontal cross bar to the other face using a U shaped connector.

9. The apparatus of claim 7 wherein at each connector location two L brackets are bolted to a wood, concrete or steel plate on opposite sides of the plate and both L brackets secure said horizontal cross bar to the other faces using a U shaped connector passing through both brackets.

10. The apparatus of claim 9 wherein said horizontal cross bar is placed between the other faces of said L brackets and is held in place using a U shaped connector passing through both brackets.

11. The apparatus of claim 7 wherein at each connector location two L brackets are bolted to a wood, concrete or steel plate on the same side of the plate and in which said horizontal cross bar is placed between the other faces of said L brackets and is held in place using a U shaped connector passing through both brackets.

12. The apparatus of claim 7 in which one face of a first L bracket in mounted to a first vertical surface with the other face lying on a horizontal surface and a second L bracket is mounted to a second vertical surface below the horizontal surface with the second face of the second bracket being parallel the other face of the first bracket.

13. The apparatus of claim 12 wherein said horizontal cross bar is mounted between the other face of the first L bracket and the second face of the second L bracket.

14. The apparatus of claim 7 wherein at each connector location two L brackets are used, in which the first L bracket is bolted to a wood, concrete or steel plate on one face and secures the horizontal cross bar to the other face using a U shaped connector and a second L bracket is connected to a mounting support for a roll of panels for the garage door horizontally displaced from the first L bracket and in which one end of the first L bracket is attached to the second L bracket using a small bracket.

15. An apparatus for bracing a roll down door of a building, the roll down door comprising a plurality of horizontal door panels adjacent one another, the apparatus comprising:

a horizontal cross bar to be mounted to the building on opposite sides of the roll down door;

at least one vertical support bar having a first end to be secured to the floor, and a second end to be secured to said horizontal cross bar, said at least one vertical support bar including at least one channel track extending along a length thereof;

at least one attachment mechanism for connecting said at least one vertical support bar to at least one of the door panels, and comprising a channel slide piece to be adjusted vertically in the at least one channel track of said at least one vertical support bar, a bracket assembly to be coupled to one of the door panels, and a hook having a rotatable end coupled to said channel slide piece, and a free end for engaging said bracket assembly; and a slide bracket including an opening extending therethrough for sliding over the second end of said at least one vertical support bar, said slide bracket comprising an extension extending outwardly therefrom for resting on an upper surface of said horizontal cross bar.

16. The apparatus of claim 15 wherein said hook includes a plurality of adjustment openings extending therethrough along the rotatable end, and wherein said channel slide track further comprises a bolt for coupling the rotatable end of said hook to said channel slide track through a selected adjustment opening.

17. The apparatus of claim 15 wherein said bracket assembly includes a U-shaped receiving area for receiving the free end of said hook.

18. The apparatus of claim 15 wherein said bracket assembly comprises front and back pieces to be coupled together on opposite sides of one of the door panels.

19. The apparatus of claim 15 wherein the extension of said slide bracket is L-shaped for resting on the upper surface and outer adjacent edge of said horizontal cross bar.

20. The apparatus of claim 15 wherein said at least one vertical support bar comprises telescoping sections, with each section having a rectangular cross section and including the at least one channel track.

21. The apparatus of claim 15 further comprising a plurality of L brackets for mounting said horizontal cross bar to the connector locations of the building.

22. A method for bracing a roll down door of a building, the roll down door comprising a plurality of horizontal door panels adjacent one another, the method comprising:

mounting a horizontal cross bar to the building at connector locations on opposite sides of the roll down door;

providing at least one vertical support bar having a first end to be secured to the floor, and a second end to be secured to the horizontal cross bar, the at least one vertical support bar including at least one channel track extending along a length thereof; and connecting the at least one vertical support bar to at least one of the door panels using at least one attachment mechanism, the at least one attachment mechanism comprising a channel slide piece to be adjusted vertically in the at least one channel track of the at least one vertical support bar, a bracket assembly to be coupled to one of the door panels, and a hook having a rotatable end coupled to the channel slide piece, and a free end for engaging the bracket assembly.

23. The method of claim 22 wherein the hook includes a plurality of adjustment openings extending therethrough along the rotatable end, and wherein the channel slide track further comprises a bolt for coupling the rotatable end of the hook to the channel slide track through a selected adjustment opening.

24. The method of claim 22 wherein the bracket assembly includes a U-shaped receiving area for receiving the free end of the hook.

25. The method of claim 22 wherein the bracket assembly comprises front and back pieces to be coupled together on opposite sides of one of the door panels.

26. The method of claim 22 further comprising a slide bracket including an opening extending therethrough for sliding over the second end of said at least one vertical support bar, said slide bracket comprising an L-shaped extension extending outwardly therefrom for resting on an upper surface and outer adjacent edge of said horizontal cross bar.

27. The method of claim 22 wherein said at least one vertical support bar comprises telescoping sections, with each section having a rectangular cross section and including the at least one channel track.

* * * * *